US008596464B2

(12) United States Patent
Robertson

(10) Patent No.: US 8,596,464 B2
(45) Date of Patent: Dec. 3, 2013

(54) SIFTING SCREENS

(75) Inventor: Graham Alexander Robertson, Edinburgh (SC)

(73) Assignee: United Wire Limited, Edinburgh, Scotland (GB)

( * ) Notice: Subject to any disclaimer, the term of this patent is extended or adjusted under 35 U.S.C. 154(b) by 334 days.

(21) Appl. No.: 12/781,125

(22) Filed: May 17, 2010

(65) Prior Publication Data

US 2010/0219110 A1 Sep. 2, 2010

Related U.S. Application Data

(63) Continuation of application No. 10/584,669, filed on May 21, 2007, now Pat. No. 7,819,254.

(30) Foreign Application Priority Data

Dec. 18, 2004 (GB) ..... 0427756.2

(51) Int. Cl.
*B07B 1/49* (2006.01)

(52) U.S. Cl.
USPC ..... 209/405; 209/392; 209/393; 209/399; 209/403

(58) Field of Classification Search
USPC ..... 209/392, 393, 399, 403, 405
See application file for complete search history.

(56) References Cited

U.S. PATENT DOCUMENTS

| | | | | |
|---|---|---|---|---|
| 2,321,675 | A * | 6/1943 | Hauge | 209/403 |
| 3,970,550 | A * | 7/1976 | Fry et al. | 209/399 |
| 4,265,742 | A * | 5/1981 | Bucker et al. | 209/399 |
| 5,851,393 | A * | 12/1998 | Carr et al. | 210/489 |
| 6,454,099 | B1 * | 9/2002 | Adams et al. | 209/399 |
| 7,819,254 | B2 * | 10/2010 | Robertson | 209/399 |
| 2006/0180509 | A1 * | 8/2006 | Burnett et al. | 209/405 |
| 2007/0221547 | A1 * | 9/2007 | Robertson | 209/399 |

* cited by examiner

*Primary Examiner* — Terrell Matthews
(74) *Attorney, Agent, or Firm* — Patents+TMS, P.C

(57) ABSTRACT

A frame over which woven wire mesh is to be stretched and secured to form a sieving screen and which can be used to screen solids from drilling mud recovered from down-hole when drilling for oil or gas. The frame is a rectilinear moulded plastics frame having edge regions by which it is secured in place in a shaker. Within the frame is a plurality of rectilinear windows formed by an orthogonal array of intersecting ribs also of moulded plastics material. Some of the ribs are internally reinforced by rigid metal members which extend orthogonally between hollow box-section members which define a sub-frame for reinforcing the four edge regions of the frame. The orthogonal members are secured at their ends to the sub-frame. The ends of the sub-frame members are joined at the four corners of the sub-frame. In this way not are only the edge regions of the frame reinforced internally but so also are some of the orthogonally intersecting ribs, so as thereby to produce a rigid frame for the screen. The internal reinforcement for those ribs which are to be reinforced may comprise hollow box-section metal members which may be of similar cross section to that of the sub-frame members, or the internal reinforcement for those ribs which are to be reinforced comprises metal I-beam cross section members, which typically have the same height as the height of the box-section members forming the sub frame.

28 Claims, 8 Drawing Sheets

SIFTING SCREENS

RELATED APPLICATION

Figure 1:
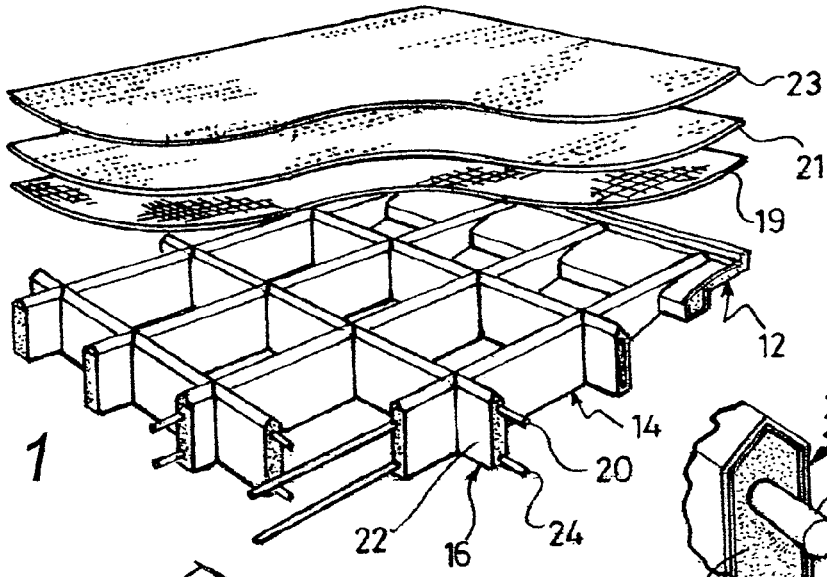

This application is a continuation of co-pending U.S. patent application Ser. No. 10/584,669, filed May 21, 2007, now U.S. Pat. No. 7,819,254.

FIELD OF INVENTION

This invention concerns sifting screens such as are fitted in shakers which are employed to separate solids from liquids, and in particular to separate solids from liquid drilling muds brought up from down-hole when drilling for oil or gas.

BACKGROUND TO THE INVENTION

Historically such screens have been constructed from sheets of woven wire mesh stretched over and secured to metal frames using a polymer adhesive. Typically the frames are generally rectangular and define one or more rectangular openings over which the wire mesh is stretched.

Usually two or more layers of wire mesh having different mesh sizes have been secured to each metal frame. The tensions in the warp and weft wires of one mesh are normally greater than the corresponding warp and weft wire tensions in the other mesh.

Forms of Frame

Such constructions tended to result in relatively heavy screens and since they are typically man-handled into position a new design of frame was introduced some years ago by the Applicant Company. This was constructed largely from a GRP polymer moulding in which a wire-frame is embodied during the moulding process, to reinforce the final structure and introduce sufficient rigidity to not only contain and preserve the tensions in the wire meshes, but also to ensure that the frames did not bend under the weight of the relatively dense slurry making up the drilling mud and the build-up of solids on the screen in use.

This design of screen was ideally suited to shakers such as the VSM range of shakers supplied by Rig Technology Ltd. of Aberdeen, Scotland, UK.

The throughput of a shaker screen is dictated at least in part by the area of the screen mesh onto which the drilling mud is deposited in use. Since the area of each rectangular frame was dictated in part by the maximum permitted weight of the final screen, filtering areas greater than that of a single screen were created by arranging two or four screens in edge to edge abutment in a rectilinear rigid basket, having edge supports on which edges of the screens rested. The screens were held in place by clamps and preferably an inflatable clamping mechanism was employed to clamp the edge of the screens onto the edge supports of the rigid basket. The inflatable clamping also ensured a good liquid-tight seal around the edges of the screens.

Other shakers have been developed which accommodate large area but less well supported screens, and it has been proposed to construct such screens using wire-frame reinforced GRP frames, but after testing prototypes they were found not to have sufficient stiffness to perform in the field.

In particular the larger area GRP wire-frame reinforced screens were observed to whip violently around the centre of the unsupported span. This resulted in the screen becoming separated from edge supports to which it should remain sealed at all times in use. This allowed slurry to bypass the screen and drop into the sump reserved for filtered liquids.

In addition the whipping of the edge regions of the screen onto the edge supports resulted in damage to the underside of the screen frame.

Furthermore, excessive whipping caused considerable splashing of slurry over the walls of the basket and onto the floor on which the shaker was mounted. Quite apart from loss of relatively expensive drilling muds, the chemicals making up the muds are not such as should be dumped at sea. Therefore any such splashing could result in environmental contamination and serious penalties for rig-operators if any such spillages are not collected and disposed of correctly, all of which increased the cost of processing and recovering the down-hole mud.

It has been proposed to construct a reinforcing structure for such a screen in which the wires extend between and are secured to the upper and lower faces of a rectangular sub frame made from lengths of metal box-section, so as to increase the rigidity of the edges of the screen. However this arrangement is not suitable for all designs of screens, especially those in which the depth of the sub-frame is restricted so that the spacing between the reinforcing wires is in turn reduced, thereby reducing the bending movement of the ribs.

It is therefore an object of the present invention to provide an improved form of relatively light-weight frame construction which is sufficiently rigid as not to whip excessively in use and can span larger screening areas than the previously produced wire reinforced GRP framed screens, but can also be employed in shakers in which the depth of the screen will not allow the ribs to be reliably reinforced by pairs of spaced apart parallel wires joined at their ends to a bounding sub-frame.

SUMMARY OF THE INVENTION

According to the present invention a frame over which woven wire mesh is to be stretched and secured to form a sieving screen which can be used to screen solids from drilling mud recovered from down-hole when drilling for oil or gas comprises a rectilinear moulded plastics frame having edge regions by which it is secured in place in a shaker and defining a plurality of rectilinear windows formed by an orthogonal array of intersecting ribs also of moulded plastics material wherein some of the ribs are internally reinforced by rigid metal members which extend orthogonally between hollow box-section members which define a sub-frame for reinforcing the four edge regions of the frame, the orthogonal members being secured at their ends to the sub-frame, and the ends of the latter are joined at the four corners of the sub-frame, so that not are only the edge regions reinforced internally but so also are some of the orthogonally intersecting ribs, so as thereby to produce a rigid frame for the screen.

In one embodiment the internal reinforcement for those ribs which are to be reinforced comprises hollow box-section metal members. These may be similar in cross section to the sub-frame members.

In another embodiment the internal reinforcement for those ribs which are to be reinforced comprises metal I-beam cross section members. Typically the I-beam members have the same height as the height of the box-section members forming the sub frame.

The box-section members of the perimeter reinforcing frame may have a square or rectangular cross-section.

Preferably the sub-frame is encapsulated in the same plastics material as forms the moulded orthogonal array of intersecting ribs.

By forming the rectangular perimeter of the screen frame from box section metal not only is the resulting screen sufficiently rigid that it will not whip when vibrated in use in a shaker but is sufficiently strong to resist bending or deformation due to mesh wire tension, can span larger areas than the reinforced GRP screens previously developed for the Rig Technology VSM series of shakers, but by using rigid metal reinforcements for the orthogonal ribs, it has been found that only some of the latter need to be reinforced as opposed to all of the ribs when wire reinforcing is employed.

The invention also lies in a screen for a shaker constructed from a frame of GRP material moulded around a frame reinforcing structure as aforesaid, and at least one layer of woven wire stretched over and secured to the upper surface of the frame so that tension is maintained in the wire cloth and the end of the manufacturing process.

In use the perimeter of the screen is sealed against rectilinear seating within a shaker basket to prevent seepage of liquid therearound. The box-section edge-region reinforcement provides sufficient strength to eliminate the separation that can occur between the frame and the seating due to whipping, and will thus solve the fluid bypass and seal damage issues. The rigid perimeter also acts as additional support for the internal reinforcements for the orthogonal ribs and this reduces the relative deflection of the grid of intersecting ribs to such an extent that excessive splashing will also be reduced if not eliminated.

The invention also lies in a screen as aforesaid when fitted in a shaker wherein the screen is clamped in position in a shaker basket using a pneumatic seal or by wedges driven into position between abutments protruding internally from the shaker basket and the upper face of edge regions of the screen.

Figure 2:
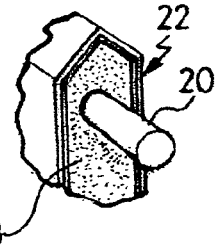
Figure 3:
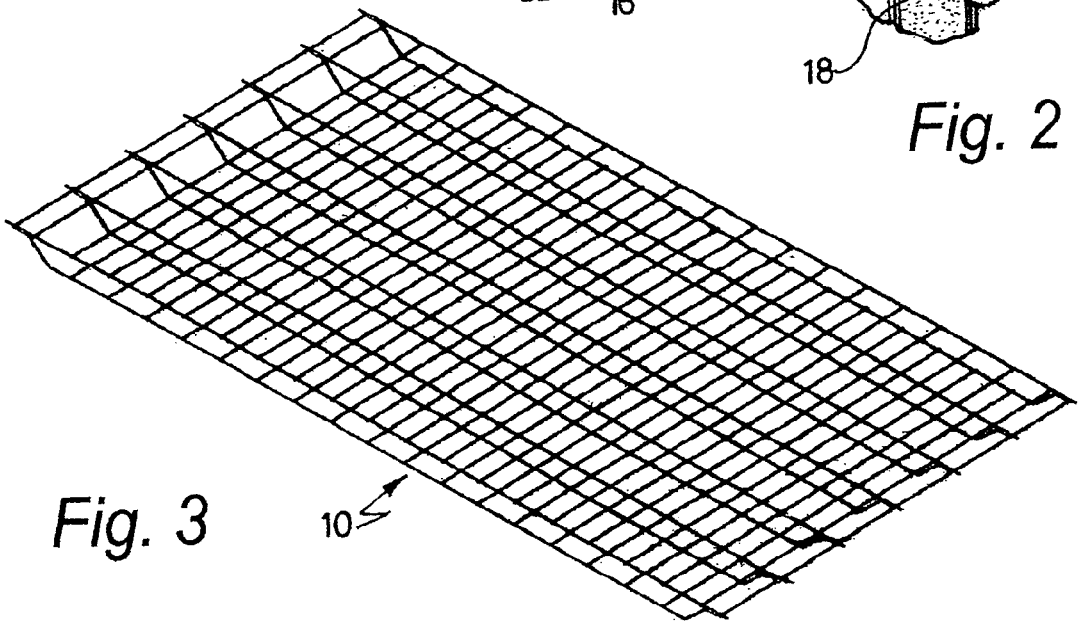
Figure 4:
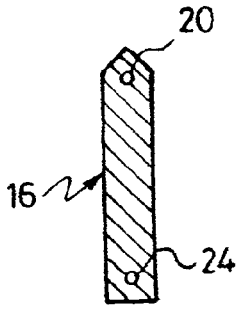
Figure 5:
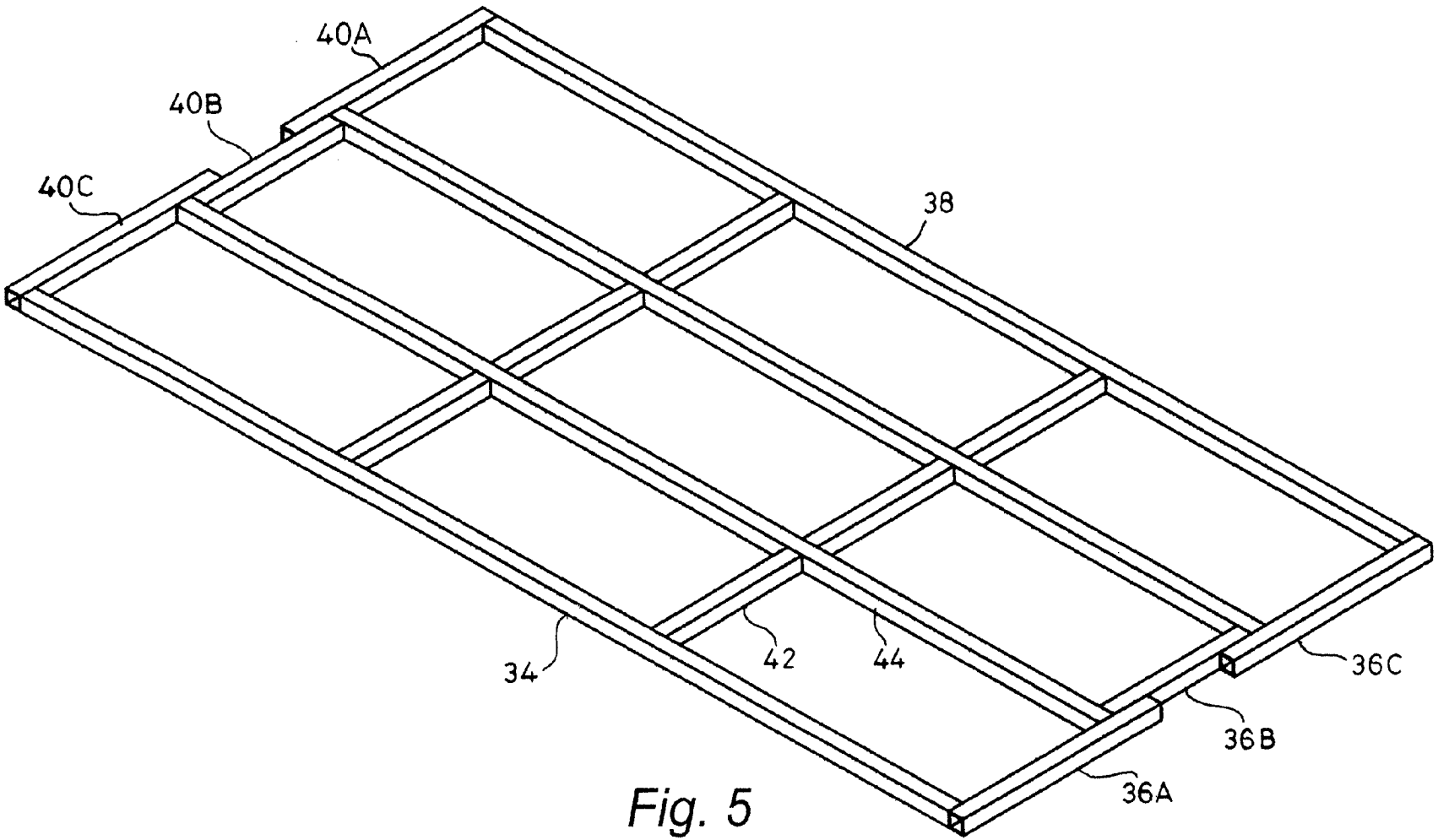
Figures 6, 7:
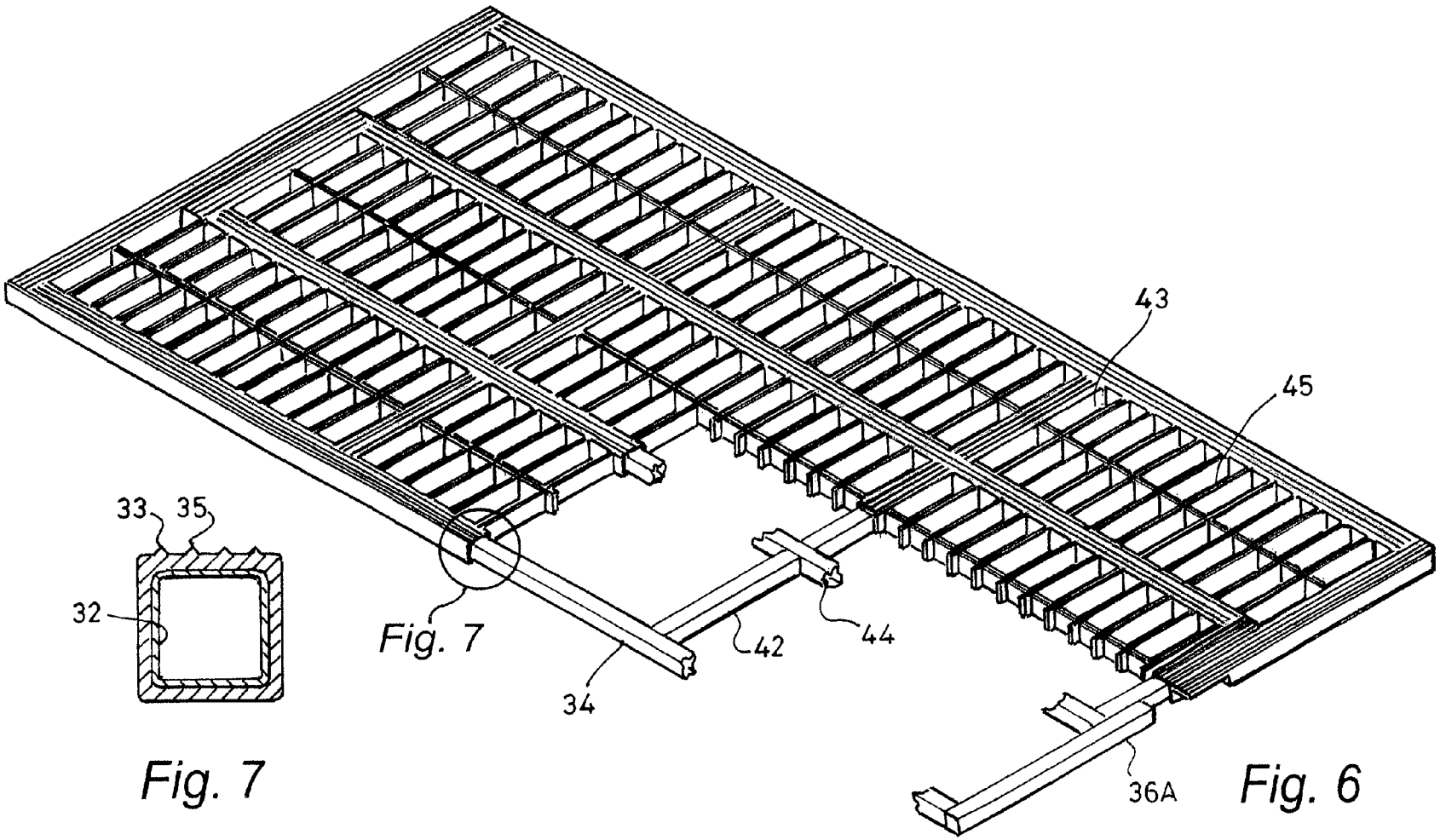

The invention will now be described by way of example with reference to the accompanying drawings, in which:

FIG. 1 is an exploded perspective view of part of a known screen,

FIG. 2 is a scrap section of the upper end of one of the intersecting array of ribs in the known frame showing a reinforcing wire embedded in the moulded GRP material, FIG. 3 is a perspective view of the welded wire reinforcement grid employed in the manufacture of the known screen, FIG. 4 is a cross-section through one of the ribs of FIG. 1 showing both upper and lower wires, FIG. 5 is a perspective view of a reinforcing structure formed entirely of box section parts and constructed as one embodiment of the invention, FIG. 6 is similar view to that of FIG. 5 after the frame has been covered by GRP and intermediate ribs have been moulded to extend between the covered frame members in which the nearside corner is cut-array to reveal the box-section frame members, FIG. 7 is a cross section to an enlarged scale through the GRP covered sub-frame of FIG. 6.

Figure 8:
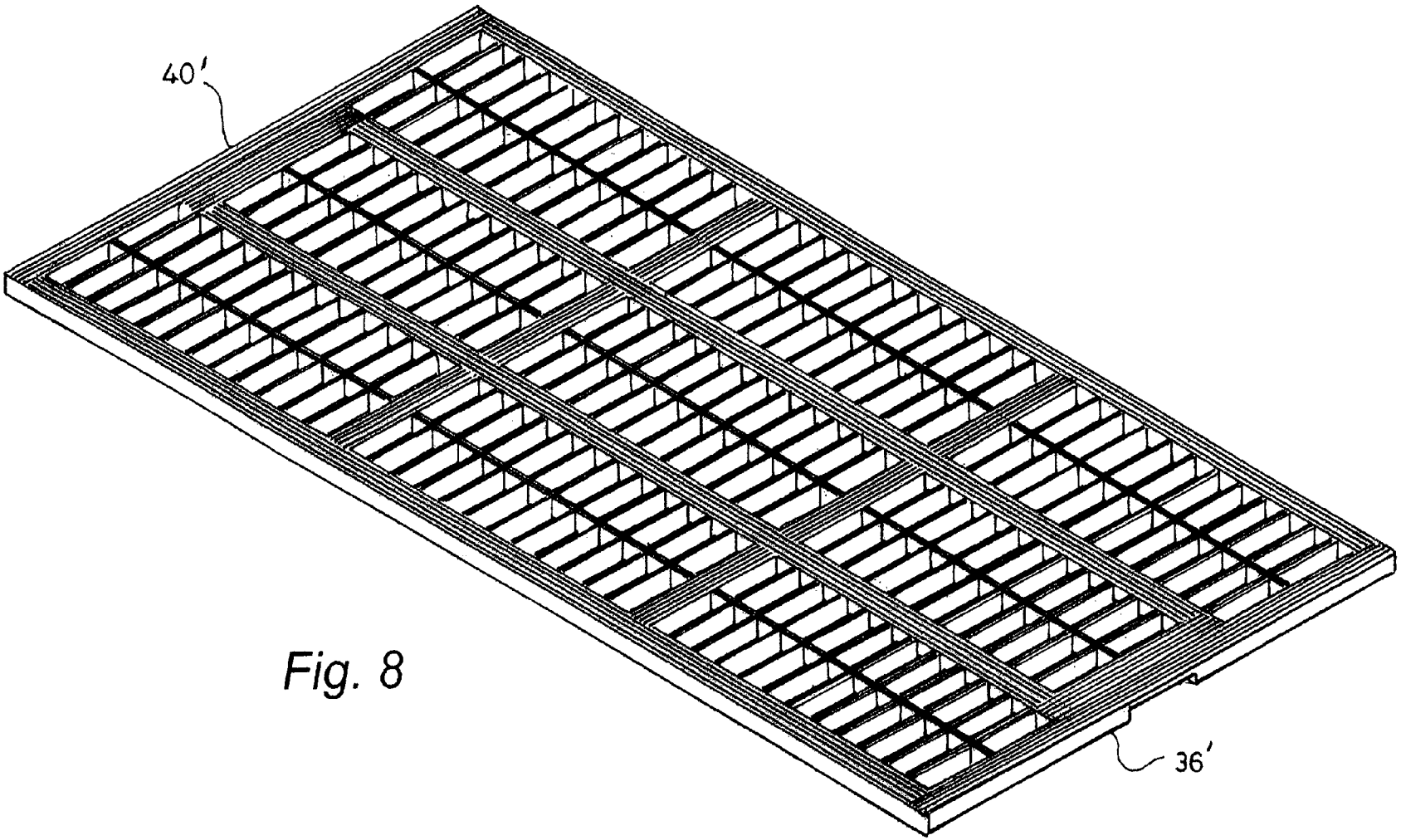
Figures 9, 10:
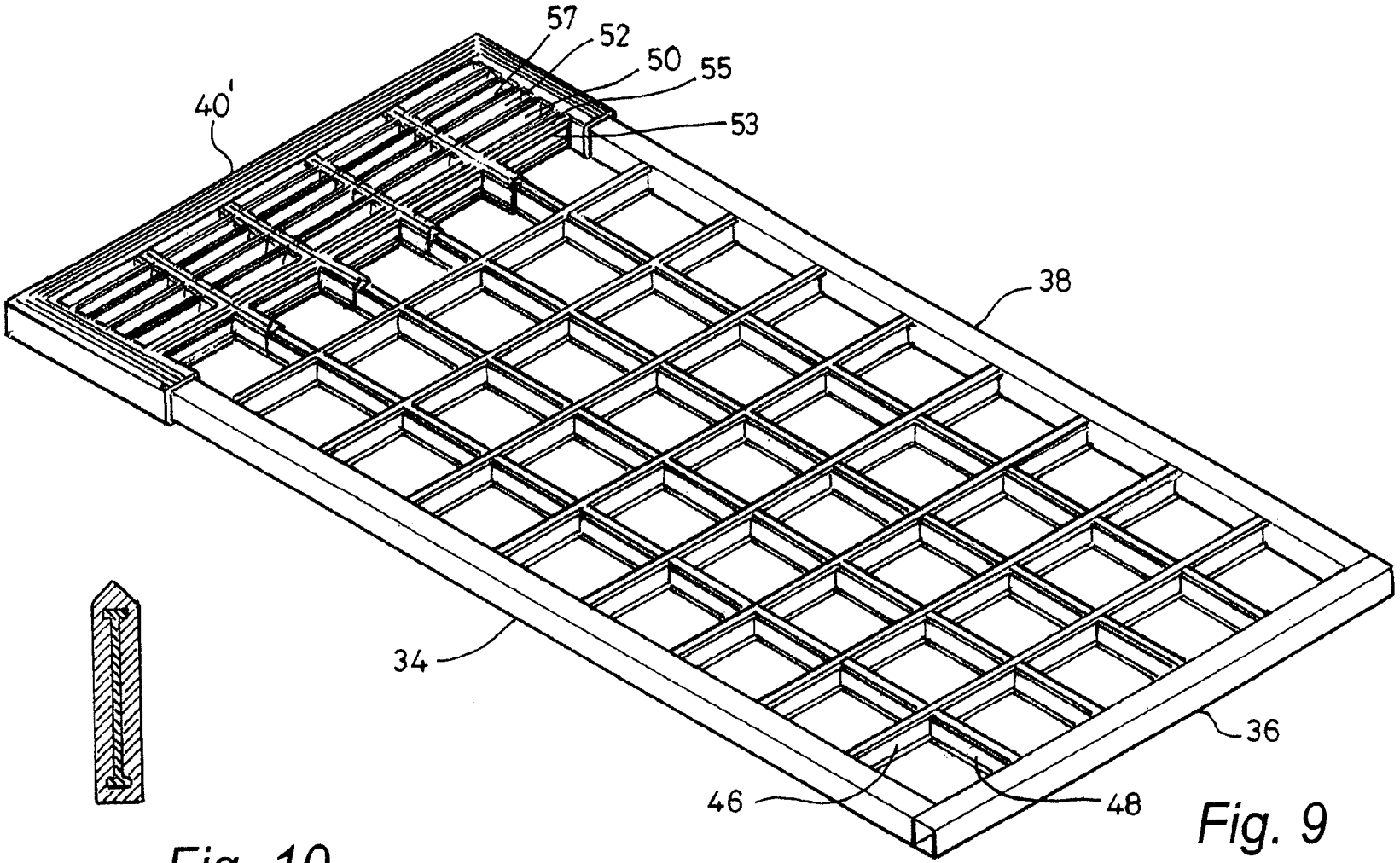
Figure 11:
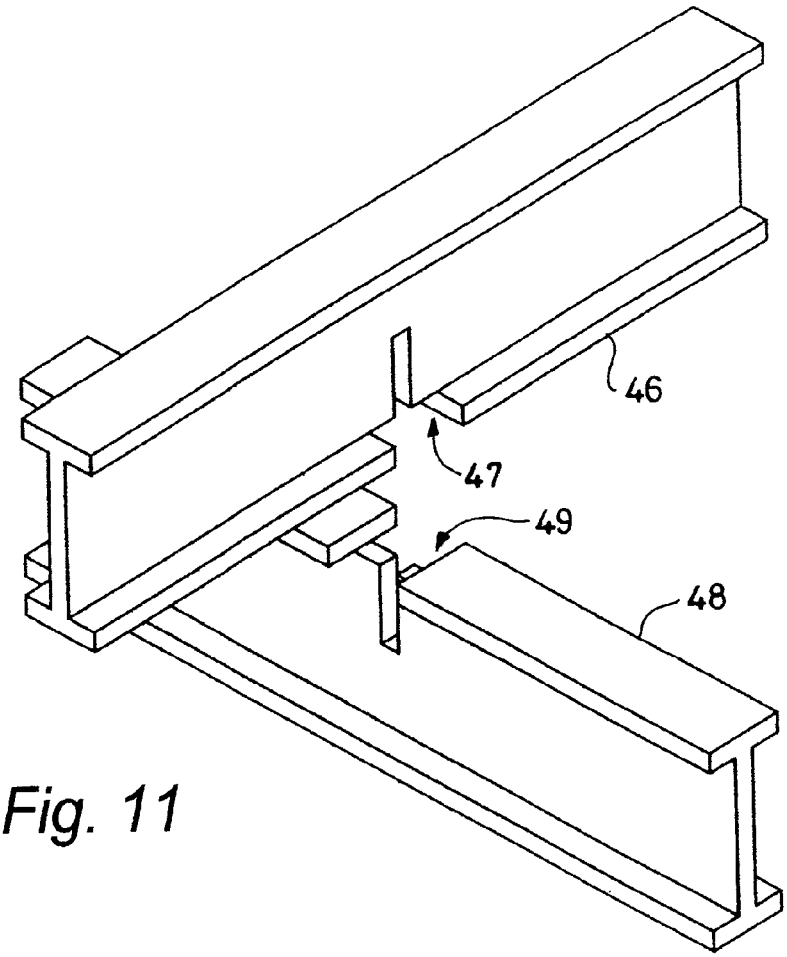
Figure 12:
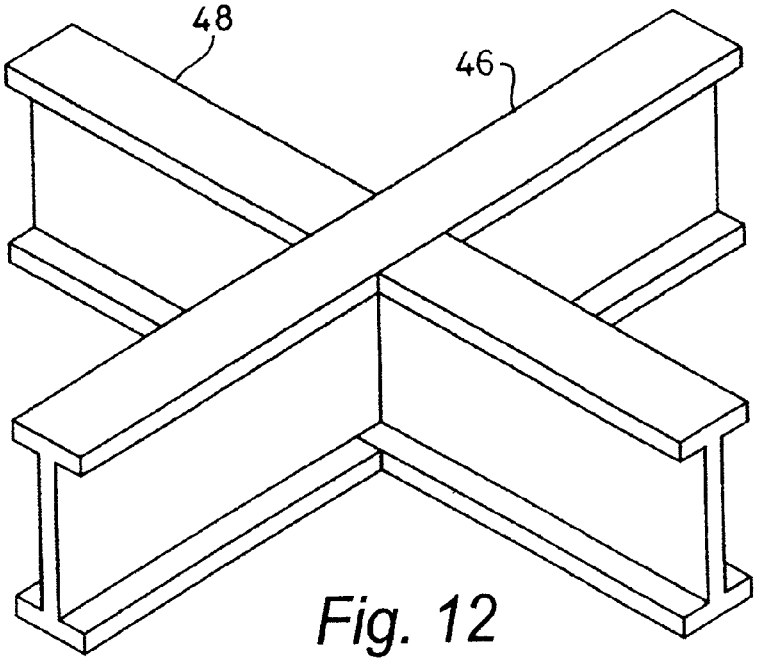
Figure 13:
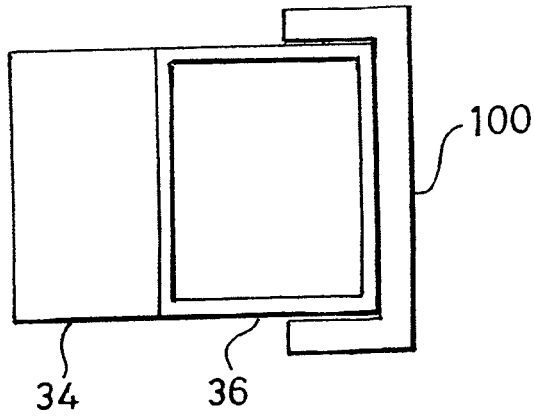
Figure 14:
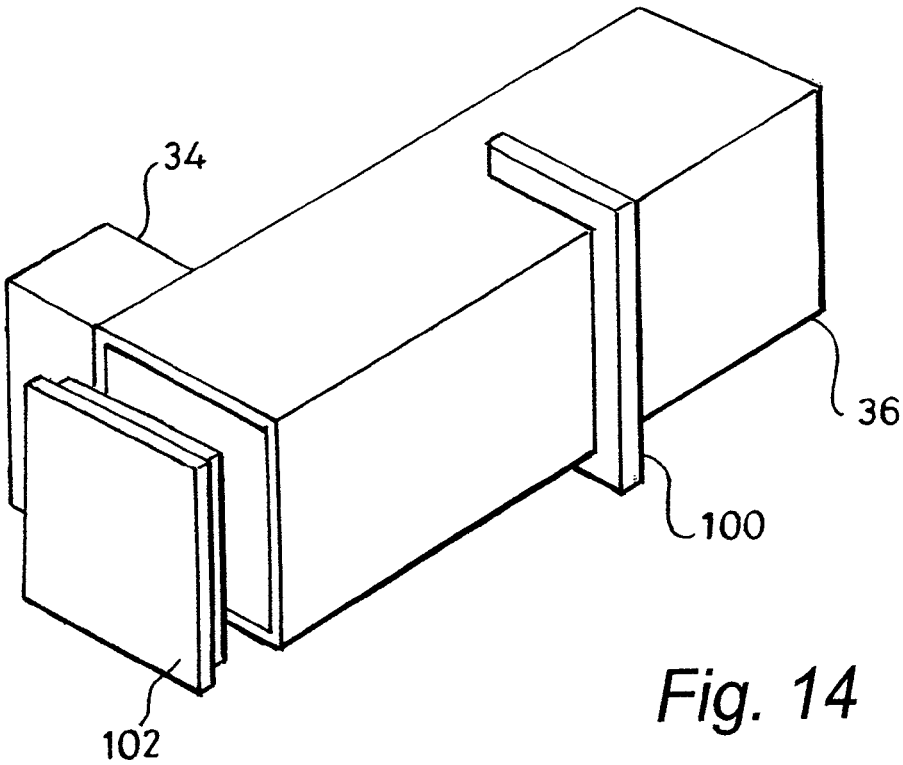
Figure 15:
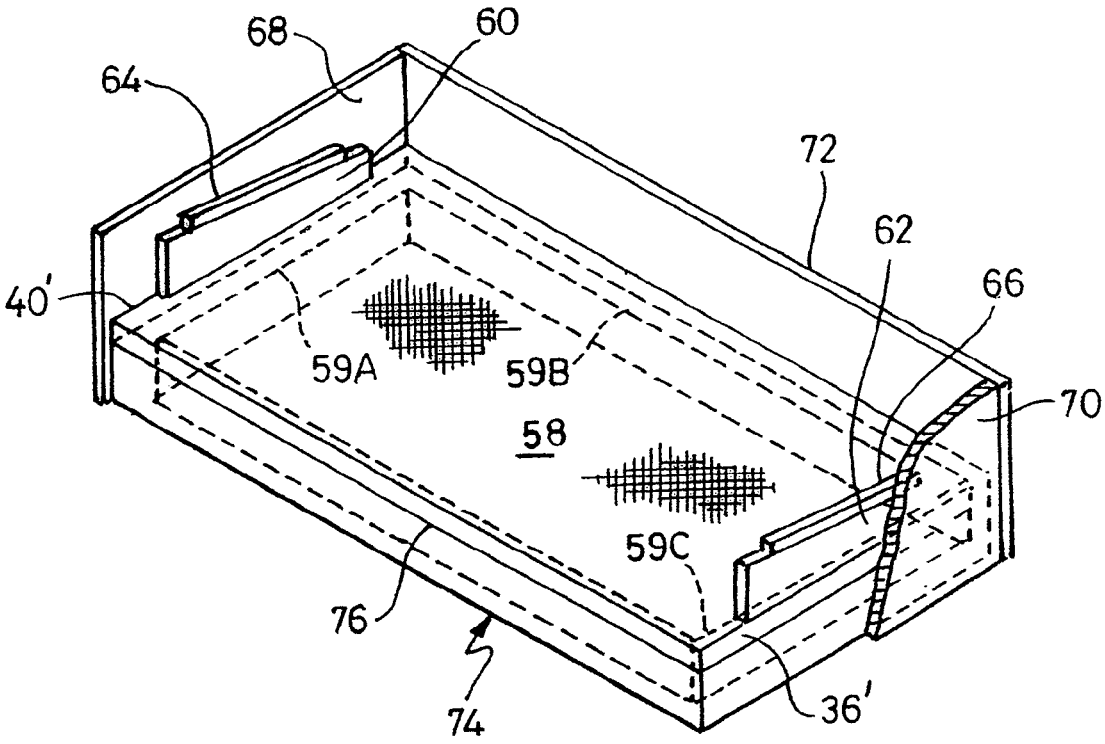

FIG. 8 is a similar view of the completed screen after the frame of FIG. 6 has been encapsulated in GRP material, FIG. 9 is a perspective view of a screen in which the internal reinforcing frame is formed partly of box sections parts and partly of I-beam section parts, FIG. 10 is an enlarged view of the intermediate ribs of the screen of FIG. 8, FIGS. 11 and 12 illustrate how the intermediate I-beam cross section members can fit together, FIGS. 13 and 14 shows how the box section parts can be supported in a mould tool, and FIG. 15 shows one technique for securing a screen in a shaker basket.

In FIG. 1 a known support frame is shown comprising a welded grid of reinforcing wires generally designated 10 (and best seen in FIG. 3) embedded in a moulded rectilinear structure defining an external rectilinear flange 12 and a grid of orthogonal intersecting ribs, two of which are denoted in FIG. 1 by 14, 16. Layers of woven wire mesh such as 19, 21, 23 are laid over, tensioned and secured to the frame in manner known per se.

The upper edges of the ribs 14, 16 are triangular in cross-section as best seen in FIG. 2 which shows the inner core of plastics material 18 embedding one of the upper layers of wires 20 and the smooth hard wearing outer skin of plastics material 22.

As best seen in FIG. 1 two wires extend through each rib, an upper wire 20 and a parallel lower wire 24.

The lower wires such as 24 are bent up and welded to the upper wires at opposite ends of each wire run, and (although not shown in FIG. 3) also along each of the two longer sides of the reinforcing framework, as depicted at 26. The double thickness of wire extending into the end and side flanges of the eventual frame have been found to provide sufficient rigidity to the flanges for the smaller area screens such as are employed in the Rig Technology Ltd VSM range of shakers.

FIG. 4 is a cross-section through the rib 16 of FIG. 1.

FIG. 5-7 show how the wire reinforcing structure of FIGS. 1-4 is replaced by a box-section reinforced frame in accordance with one aspect the invention. The metal box-section 32 may be square as shown but other cross-section shapes are possible such as rectangular or triangular. The box-section reinforcement members 34, 36, 38, 40 create a rigid non-flexing sub-frame for the screen. The ends of the sub-frame are formed from three staggered lengths of box-section such as 36A, 38B and 36C so as to create handholds in the final screen.

The corners of the box-section sub frame are butt joints which are welded.

Intermediate cross members, such as 42 and 44 stretch from side to side, and end to end, of the rectangular sub-frame formed by box-section members 34-40. The intermediate cross members and the sub-frame members are welded or glued together to form the structure shown in FIG. 5.

A screen which incorporates the reinforcing frame constructed in accordance with FIGS. 5-7 is formed by inserting the frame into a mould tool and injecting a GRP material under pressure into the tooling so as to encapsulate the frame in the plastics material, to form a finished frame such as is shown in FIG. 8. The encapsulated assembly is shown partly cut away in FIG. 6 to reveal the reinforcing members 34, 36A, 42 and 44.

FIG. 9 illustrates how the intermediate box-section cross members 42,44 can be replaced by I-beam cross section members, such as 46, 48.

The ends of the I-beam section members are welded or glued to the box section parts 34, 36 etc.

As shown in FIGS. 11 and 12 the I-beam members intersect by means of halving joints formed by cutting away 46 at 47 and 48 at 49.

As with the screen of FIGS. 5-7, non-reinforced ribs of GRP, 50, 52 etc., are moulded so as to extend between the ends of the frame and the parallel spaced apart ribs such as 46.

The encapsulated box-section parts 34, 36 etc., are formed with parallel triangular spaced apart ridges such as shown at 33, 35 in FIG. 7.

Similar parallel spaced apart ridges are formed along the upper surfaces of the reinforced moulded ribs such as 43 in FIG. 6 and 53 in FIG. 9. The ridges are identified by 55 in FIG.

9, and single a rib formed along the upper edge of each of the non-reinforced ribs (such as 45 in FIG. 6 and 50, 52 in FIG. 9), is as shown at 57 in FIG. 9.

The ridges of GRP material are melted during the screen manufacturing process to secure layers of woven wire cloth in place.

Since the box-section sub frame and the box section or I-beam intermediate members are to be encapsulated by the plastics material, it is necessary for the former at least to be stood-off from the inside of mould tool, and to this end C-clips such as 100 are fitted at points around the box-section parts 78, 80 etc., as shown in FIGS. 13 and 14. In addition open ends of the box-section are plugged before moulding by means of plugs 102 as shown in FIG. 14. The latter may be of plastics material or metal. Standoffs may be incorporated into the top and bottom of the mould tool to space the intermediate members from the tool.

A method of securing the screen in a shaker basket 46 is shown diagrammatically in FIG. 15.

Here the opposite side edges 36' and 40' of a screen 58 are shown clamped between a lower supporting structure (shown in dotted outline at 59A, 59B and 59C) which forms a seating for the screen edges, and two blocks 64, 66. Two wedges 60, 62 are driven into position and wedged below blocks 64, 66 which protrude laterally and inwardly from the shaker basket 46, to secure the screen in place.

The rear wall of the basket is shown at 72 and a reduced height front wall is shown at 74. The latter provides support for one of the longer edges of the screen, while the seating part 59B provides support for the other longer edge of the screen.

The wedges 60, 62 ensure that the side edges of the screen are sealed to the seating parts 59A, 59B, but unless the screen structure is sufficiently rigid as to prevent flexing and whipping, the seal between the longer edges of the screen and the front and rear seating parts 74, 59B can be broken in use. This allows fluid to seep around the longer edges of the screen. The junction between two of the edges in question is shown at 76 in FIG. 15.

The invention claimed is:

1. An apparatus comprising:

edge members joined together forming a perimeter of a frame;

intermediate members extending orthogonally between the edge members defining a subframe having rectilinear windows wherein the edge members and the intermediate members are internally reinforced by hollow rigid metal members; and an array of intersecting ribs extending orthogonally between the rectilinear windows wherein a portion of the ribs are internally reinforced by the rigid metal members, and further wherein the rigid metal members reinforcing the ribs are connected at their ends to the hollow rigid metal members forming the subframe and the ends of the subframe are connected to the hollow rigid metal members internally reinforcing the edge members.

2. The apparatus as claimed in claim 1 wherein the rigid metal members of the ribs are I-beam cross-section members.

3. The apparatus as claimed in claim 2 wherein the I-beam members have the same height as the height of the hollow rigid metal members forming the subframe.

4. The apparatus as claimed in claim 1 wherein the hollow rigid metal members of the edge members have a rectangular cross-section.

5. The apparatus as claimed in claim 1 wherein the hollow rigid metal members of the edge members have a square cross-section.

6. The apparatus as claimed in claim 1 wherein the frame is encapsulated in moulded plastics material by overmoulding the rigid metal members of the frame in an injection mould.

7. The apparatus as claimed in claim 1 further comprising a screen having GRP material moulded around the frame and having at least one layer of woven wire mesh stretched thereover and embedded therein.

8. The apparatus as claimed in claim 7 further comprising a shaker having a shaker basket wherein the screen is removably coupled to the shaker basket.

9. The apparatus as claimed in claim 8 wherein the screen is coupled to the shaker basket using a pneumatic seal.

10. The apparatus as claimed in claim 1 further comprising:

C-shaped clips fitted to the edge members of the frame before the frame is inserted into a mould tool wherein the edge members are stood-off from the inside of the mould tool to permit GRP material to encapsulate the frame members during the moulding process.

11. The apparatus as claimed in claim 10 wherein open ends of the hollow rigid metal members are plugged with metal or GRP material before the frame is inserted into the mould tool.

12. The apparatus as claimed in claim 8 wherein the screen is coupled to the shaker basket by wedges driven into position between abutments protruding internally from the shaker basket and an upper face of the edge members of the frame.

13. An apparatus comprising:

edge members forming a perimeter of a frame, wherein the edge members are internally reinforced by rigid members; and an array of intersecting ribs extending orthogonally between the edge members defining a rectilinear subframe within the perimeter of the frame, wherein a portion of the ribs are internally reinforced by rigid metal members having an I-beam cross-section and further wherein the rigid metal members having the I-beam cross-section reinforcing the ribs are connected at their ends to the rigid metal members internally reinforcing the edge members of the frame.

14. The apparatus as claimed in claim 13 wherein the rigid metal members are hollow.

15. The apparatus as claimed in claim 13 wherein the I-beam members have the same height as the height of the hollow rigid metal members.

16. The apparatus as claimed in claim 13 wherein the hollow rigid metal members of the edge members have a rectangular cross-section.

17. The apparatus as claimed in claim 13 wherein the hollow rigid metal members of the edge members have a square cross-section.

18. The apparatus as claimed in claim 13 wherein the frame is encapsulated in moulded plastics material by overmoulding the rigid metal members of the frame in an injection mould.

19. The apparatus as claimed in claim 13 further comprising a screen having GRP material moulded around the frame and having at least one layer of woven wire mesh stretched thereover and embedded therein.

20. The apparatus as claimed in claim 19 further comprising a shaker having a shaker basket wherein the screen is removably coupled to the shaker basket.

21. The apparatus as claimed in claim 20 wherein the screen is coupled to the shaker basket using a pneumatic seal.

22. The apparatus as claimed in claim 13, further comprising:

C-shaped clips fitted to the edge members of the frame before the frame is inserted into a mould tool wherein the edge members are stood-off from the inside of the mould tool to permit GRP material to encapsulate the frame members during the moulding process.

23. The apparatus as claimed in claim 22 wherein open ends of the hollow rigid metal members are plugged with metal or GRP material before the frame is inserted into the mould tool.

24. The apparatus as claimed in claim 20 wherein the screen is coupled to the shaker basket by wedges driven into position between abutments protruding internally from the shaker basket and an upper face of the edge members of the frame.

25. An apparatus, comprising:

edge members forming a perimeter of the frame, wherein the edge members are internally reinforced by rigid metal members having a hollow cross-section;

an array of intersecting ribs extending orthogonally between the edge members defining a rectilinear subframe within the perimeter of the frame, wherein a portion of the ribs are internally reinforced by the rigid metal members having a hollow cross-section wherein the rigid metal members reinforcing the ribs are connected at their ends to the hollow cross-section members forming the rectilinear subframe and the ends of the subframe are connected to the rigid metal members internally reinforcing the edge members of the frame; and C-shaped clips fitted to the edge members of the subframe to permit material to encapsulate the edge members during a molding process.

26. An apparatus, comprising:

edge members forming a perimeter of the frame, wherein the edge members are internally reinforced by rigid metal members having a hollow cross-section;

an array of intersecting ribs extending orthogonally between the edge members defining a rectilinear subframe within the perimeter of the frame, wherein a portion of the ribs are internally reinforced by the rigid metal members having a hollow cross-section, and further wherein the rigid metal members reinforcing the ribs are connected at their ends to the hollow cross-section members forming the rectilinear subframe and the ends of the subframe are connected to the rigid metal members internally reinforcing the edge members of the frame; and C-shaped clips fitted to the edge members of the subframe to permit material to encapsulate the edge members during a molding process wherein open ends of the rigid metal members having a hollow cross-section are plugged with metal or GRP material before the frame is inserted into the mould tool.

27. An apparatus comprising:

edge members forming a frame, wherein the edge members are internally reinforced by rigid members; and an array of intersecting ribs extending orthogonally between the edge members defining a rectilinear subframe within the perimeter of the frame, wherein a portion of the ribs are internally reinforced by rigid metal members having an I-beam cross-section, and further wherein the rigid metal members having the I-beam cross-section reinforcing the ribs are connected at their ends to the rigid metal members internally reinforcing the edge members of the frame; and C-shaped clips fitted to the edge members of the subframe to permit material to encapsulate the edge members during a molding process.

28. An apparatus comprising:

edge members forming a frame, wherein the edge members are internally reinforced by rigid members; and an array of intersecting ribs extending orthogonally between the edge members defining a rectilinear subframe within the perimeter of the frame, wherein a portion of the ribs are internally reinforced by rigid metal members having an I-beam cross-section, and further wherein the rigid metal members having the I-beam cross-section reinforcing the ribs are connected at their ends to the rigid metal members internally reinforcing the edge members of the frame; and C-shaped clips fitted to the edge members of the subframe to permit material to encapsulate the edge members during a molding process wherein open ends of the rigid metal members having a hollow cross-section are plugged with metal or GRP material before the frame is inserted into the mould tool.

* * * * *